United States Patent [19]

Tittizer

[11] Patent Number: 4,791,895

[45] Date of Patent: Dec. 20, 1988

[54] ELECTRO-MAGNETIC-HYDRAULIC VALVE DRIVE FOR INTERNAL COMBUSTION ENGINES

[75] Inventors: Gabriel Tittizer, Rösrath, Fed. Rep. of Germany

[73] Assignee: Interatom GmbH, Bergisch-Gladbach, Fed. Rep. of Germany

[21] Appl. No.: 52,188

[22] Filed: May 18, 1987

Related U.S. Application Data

[62] Division of Ser. No. 827,290, Feb. 6, 1986, abandoned.

[30] Foreign Application Priority Data

Sep. 26, 1985 [DE] Fed. Rep. of Germany ..... 3534388

[51] Int. Cl.[4] ..... F01L 9/02

[52] U.S. Cl. ..... 123/90.12; 123/90.11

[58] Field of Search ..... 123/90.11, 90.12, 90.13, 123/90.16

[56] References Cited

U.S. PATENT DOCUMENTS

| | | | |
|---|---|---|---|
| 1,696,984 | 1/1929 | Trbojevich | 123/90.12 |
| 2,306,131 | 12/1942 | Lossau | 123/90.12 |
| 3,209,737 | 10/1965 | Omotehara et al. | 123/90.12 |
| 3,738,337 | 6/1973 | Massie | 123/90.12 |
| 4,174,687 | 11/1979 | Fuhrmann | 123/90.13 |
| 4,258,672 | 3/1981 | Hietikko | 123/90.12 X |
| 4,476,823 | 10/1984 | Williams | 123/90.12 |

FOREIGN PATENT DOCUMENTS

| | | | |
|---|---|---|---|
| 3400192 | 7/1985 | Fed. Rep. of Germany | 123/90.12 |
| 0170414 | 9/1984 | Japan | 123/90.12 |
| 0206606 | 11/1984 | Japan | 123/90.12 |

*Primary Examiner*—Willis R. Wolfe

*Attorney, Agent, or Firm*—Herbert L. Lerner; Laurence A. Greenberg

[57] ABSTRACT

Valve drive for a combustion engine with an hydraulic transmission system between a control member and a valve includes a device for stepping up the hydraulic transmission.

5 Claims, 1 Drawing Sheet

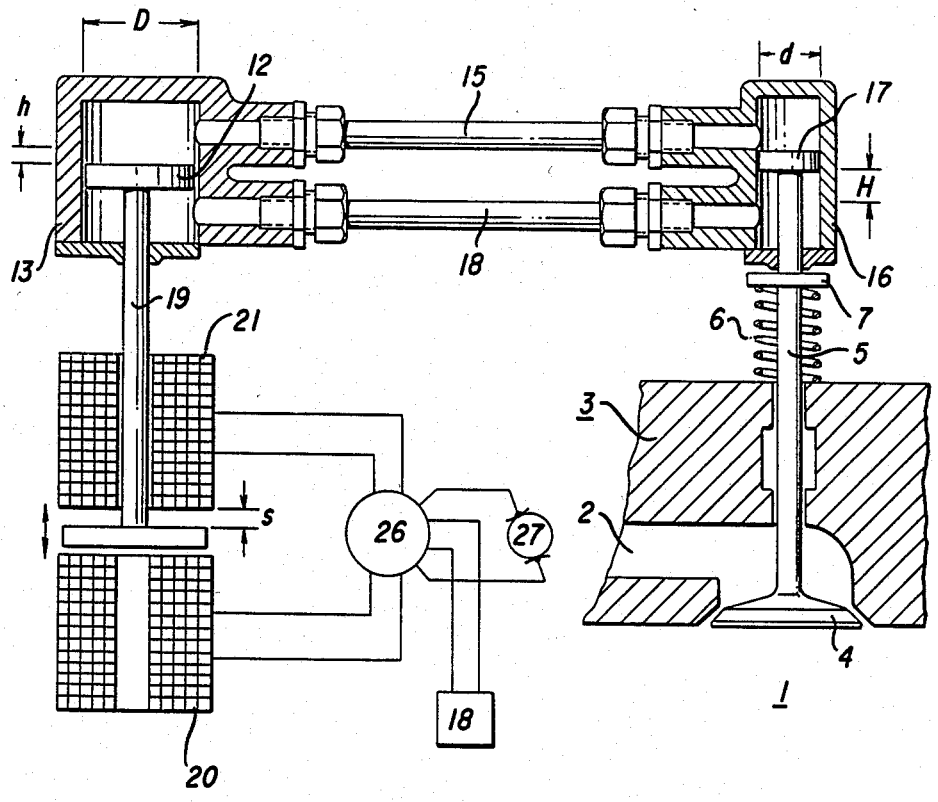
D
h
12
15
d
17
H
13
18
16
19
21
6
7
5
3
s
26
27
2
4
1
18
20

ELECTRO-MAGNETIC-HYDRAULIC VALVE DRIVE FOR INTERNAL COMBUSTION ENGINES

This is a divsional of application Ser. No. 827,290, filed Feb. 6, 1986 now abandoned.

The invention relates to a valve drive for combustion engines,for example, four-cycle Otto and diesel motors, respectively, with an hydraulic transmission and, more particularly, to such an hydraulic transmission which connects a control member with the valve.

Such machines have at least two valves per cylinder which, in accordance with the prior state of the art, are forced by spring action into the closed position thereof and are thereby brought into the open position thereof by the application of a force to the valve shaft which is opposite to and exceeds the spring force; this is accomplished by mounting cams on an auxiliary shaft driven at half the rotary speed of the crankshaft, the cams applying the required force via rocking levers to the valve tappet. The cams and rocking levers are subjected to considerable wear by sliding against one another, and the length of the valve stroke or lift which is attainable is limited by the fact that the slide slope of the cams cannot be chosen to be arbitrarily large if the forces which are to be applied through the cooperation of the cams and the rocking levers are not supposed to exceed the permissible amount. Results of recent investigations support the assumption that more complete combustion in the cylinder and, accordingly, a more advantageous fuel utility and reduction in harmful material given off in the waste gas can be attainable by increasing the valve lift or stroke and/or by opening and closing the valve more rapidly, so that the rigid coupling of the setting or position of the valve to that of the piston is relaxed for all operating conditions. Such a coupling which is variable in accordance with the operating condition occurs, in fact, when ignition takes place in Otto engines. Hydraulic valve drives are known, for example, from German Pat. No. 467 440. Greater freedom of movement is achieved therewith in the coupling between the crankshaft and the closing member of the shaft. To compensate for loss of hydraulic liquid and prevent the occurrence of air bubbles in the system, the German patent suggests that the stroke volume or piston displacement of the primary, active hydraulic cylinder be designed somewhat larger than that of the secondary, passive cylinder and the thus advanced excess be permitted to flow or drain off.

Electromagnetic valve drives are also already known, for example, from German Published Nonprosecuted Applications No. 33 11 250 and 30 24 109. Attempts are made therein to move a closing member of the valve, which is constructed as an armature of an electromagnet, over the selected displacement path (which may be a few millimeters, for example, for a motor vehicle engine of 100 KW) by excitation of the elecromagnet. This requires relatively large electromagnets which are not only costly, but also are often very difficult to accommodate in the immediate vicinity of the motor block.

It is accordingly an object of the invention to provide a valve drive with an hydraulic transmission which, while basically maintaining the existing construction of the aforementioned engines, affords a greater valve stroke or lift than heretofore provided, and simultaneously eliminates wear-prone components and thereby attains more desirable control characteristics or behavior for the valve.

With the foregoing and other objects in view, there is provided, in accordance with the invention, a valve drive for a combustion engine with an hydraulic transmission system between a control member and a valve, comprising means for stepping up the hydraulic transmission.

In accordance with another feature of the invention, the valve has a first cylinder wherein a first piston displaceable by the control member slides and a second cylinder tightly connected by at least one line to the first cylinder and having a second piston slidable therein for moving the valve, the diameter of the first cylinder being larger than the diameter of the second cylinder, the first and the second cylinder and the at least one line forming a closed system. The first piston thus follows the movement executed by the second piston with a stroke distance or lift which is increased in accordance with the difference in the respective cross-sectional areas of the cylinders, when the system is closed.

In accordance with an alternative feature of the invention, the valve drive includes a first electromagnet excitable in accordance with operating parameters of the combustion engine, especially in synchronism with the rotary speed of the engine, and an armature connected to the first piston and pullable by the first electromagnet. Only a very short displacement path, in the order of magnitude of 1 to 1.5 mm, is required for the armature of the proposed first electromagnet, for which relatively small electromagnetic forces are sufficient. This relatively small movement is then increased to the desired valve stroke or lift by the hydraulic transmission. The restoration of the armature to its starting position when the electromagnet is deenergized can be effected in a conventional manner through the force of a restoring spring.

In accordance with an added feature of the invention, the valve drive includes a second electromagnet spatially disposed opposite the first electromagnet and excitable at a timewise offset from the second electromagnet, and another line connecting the first cylinder to the second cylinder and, with respect to the one line, respectively, terminating at the opposite side of the respective cylinder. The restoring spring can therefore be dispensed with in such an embodiment, or its strength or force can be reduced to an extent sufficient to match the mechanical play. For every displacement device or set-up of the primary piston, a special electromagnet is provided which is alternatively excited with the others. The differential piston arrangement has the effect that a displacement of the one piston, no matter in which direction, always results in a corresponding displacement of the other piston.

Especially suitable for introduction into the foregoing construction and, in accordance with an additional feature of the invention, a pot-shaped or shielded magnet can serve as the first and/or second electromagnets.

Other features which are considered as characteristic for the invention are set forth in the appended claims.

Although the invention is illustrated and described herein as embodied in a valve drive with an hydraulic transmission, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single figure of the drawing. The FIGURE shows a schematic and diagrammatic sectional view of the valve drive which is of electromagnetic hydraulic-mechanical construction.

Referring now to the single FIGURE of the drawing there is shown part of a combustion chamber 1 of a cylinder of a combustion engine, to which a fuel-air mixture is fed via a suction or intake channel 2. A non-illustrated outlet channel for the combustion products can generally be constructed in a similar manner.

The suction or intake channel 2 is closed off the combustion chamber 1 by a valve disc 4 forming a unitary structure with a tappet 5. By means of an helical spring 6, which is braced against an abutment 7, the valve disc 4 is biased in closing direction of the valve.

Referring now to the single figure of the drawing, there is seen a the first piston 12 in a first cylinder 13, that is integral with an armature 19 which engages a first electromagnet 20 or a second electromagnet 21 depending upon the excitation thereof which is taking place alternatively. In this regard, an air gap s between the spaced electromagnets 20 and 21 is only approximately 1 to 1.5 mm wide so that relatively weak and, accordingly, small electromagnets can be used. This is true especially if, no force has to be applied against a powerful restoring spring , but rather, the spring 6 which forces the valve disc 4 into the closed position thereof serves solely to compensate for play and can accordingly be constructed with a relatively weak spring force.

The excitation of the electromagnets 20 and 21 is effected alternatingly by a control unit 26 which takes into account not only the respective rotary speed of the machine, for example, taken off a crankshaft 27, but also other operating data, which are determined by suitably positioned sensors 18. The most accurate valve closing times are thereby able to be controlled in accordance with the respective operating condition.

The first cylinder 13 is connected to a second cylinder 16 having a second piston 17 via two lines 15 and 18 in such a manner that each of the lines 15 and 18 terminates on one side of the respective first and second pistons 12 and 17. The latter then follows every movement of the former without any restoring spring.

We claim:

1. Valve drive for a combustion engine with a hydraulic transmission system between a control member and a valve, comprising means for stepping up the hydraulic transmission, the valve having a first cylinder wherein a first piston displaceable by the control member slides and a second cylinder tightly connected by at least one line to said first cylinder and having a second piston slideable therein for moving the valve, the diameter of said first cylinder being larger than the diameter of said second cylinder, said first and said second cylinder and said at least one line forming a closed system, a first electromagnet excitable in accordance with operating parameters of the combustion engine, and armature means connected to said first piston and pullable by said first electromagnet for electrically generating and electrically controlling force for moving the valve.

2. Valve drive according to claim 1, including a first electromagnet spatially disposed opposite said first electromagnet and excitable at a timewise offset from said second electromagnet, and another line connecting said first cylinder to said second cylinder and, with respect to said one line, respectively, terminating at the opposite side of the respective cylinder.

3. Valve drive according to claim 1 wherein said first electromagnet is a pot-shaped or shielded magnet.

4. Valve drive according to claim 2 wherein said second electromagnet is a pot-shaped or shielded magnet.

5. Valve drive according to claim 1 wherein said valve includes a shaft integrated with said second piston.

* * * * *